US007015872B1

(12) United States Patent
Little

(10) Patent No.: US 7,015,872 B1
(45) Date of Patent: Mar. 21, 2006

(54) MAST ASSEMBLY

(76) Inventor: Carl H. Little, 2188 Grandview Dr., Jamestown, NY (US) 14701

( * ) Notice: Subject to any disclaimer, the term of this patent is extended or adjusted under 35 U.S.C. 154(b) by 22 days.

(21) Appl. No.: 10/890,341

(22) Filed: Jul. 13, 2004

(51) Int. Cl.
*H01Q 1/12* (2006.01)

(52) U.S. Cl. ..... 343/890; 343/874; 343/882

(58) Field of Classification Search ..... 343/874, 343/878, 880, 882, 890
See application file for complete search history.

(56) References Cited

U.S. PATENT DOCUMENTS

| | | | | |
|---|---|---|---|---|
| 2,875,865 | A * | 3/1959 | Rohn | 52/116 |
| 3,656,170 | A | 4/1972 | Smith | 343/882 |
| 4,460,895 | A | 7/1984 | Bert et al. | 343/713 |
| 4,866,893 | A * | 9/1989 | McGinnis | 52/108 |
| 5,537,125 | A * | 7/1996 | Harrell et al. | 343/878 |
| 5,782,042 | A * | 7/1998 | Klein | 52/116 |
| 6,466,181 | B1 | 10/2002 | Ho et al. | 343/882 |
| 6,582,147 | B1 | 6/2003 | Pursiheimo | 403/97 |
| 6,809,702 | B1 * | 10/2004 | Safakhah | 343/890 |

OTHER PUBLICATIONS

"Sommer Two-Position Mast Clamp," Sommer Antennas. http://www.sommerantennas.com/clamps.html, Aug. 5, 2003.

"Wind damage brings repair solution", Buddy Clifton, QST Magazine, Sep. 2003, p. 21.

* cited by examiner

*Primary Examiner*—Shih-Chao Chen
(74) *Attorney, Agent, or Firm*—Simpson & Simpson, PLLC

(57) ABSTRACT

An antenna installation having a tower including supporting a mast supported adjacent its upper end and in turn being supported adjacent its lower end by a first hinge mechanism for pivotal movement about a first horizontally disposed hinge axis between a generally horizontally disposed lowered and vertically upstanding use positions; an antenna including a boom mounted on said mast and a plurality of antenna elements mounted on said boom to lie within plane disposed generally normal to said mast when in upstanding use position; and a hinge mechanism for supporting the antenna for pivotal movement about a second generally horizontally disposed hinge axis adopted to be disposed parallel to the first hinge axis and including gravity responsive latch means for controlling against pivotal movement of the antenna relative to the mast.

18 Claims, 4 Drawing Sheets

MAST ASSEMBLY

BACKGROUND OF THE INVENTION

It is known to support an antenna on a mast, which is in turn mounted on the upper end of a tower supported adjacent its lower end for pivotal movement about a horizontally disposed axis, so as to allow the antenna to be lowered into a position adjacent to the ground in order to facilitate access to the antenna. However, while some access to an antenna is affixed when a tower is tilted into a position near the ground, such access is somewhat limited in case of larger antennas by ground engagement of the ends of the antenna boom or elements, which may have lengths exceeding thirty and forty feet respectively. Further lowering of the antenna may be permitted by use of a ladder to access a boom-mast clamp securing the boom to the mast in order to permit swinging movement of the antenna about the axis of the boom to lie more or less parallel to the ground. After work on the antenna is completed, the tower must be partially raised and a ladder again used to afford access to the boom-mast clamp for the purposes of clamping the boom relative to the mast, such that they are retained in desired orientation relative to the mast when the tower is again swung into its normal upstanding or use position.

It has been proposed to telescopically mount a mast in order to permit lowering of an antenna, but again a ladder may be required to afford access to the antenna. The use of ladders tends to be time consuming and undesirable from a safety standpoint.

It has been a common practice for the case of antenna mounted fixed upright towers to use a crane or high lift to provide access to the antenna, but again this requires one or more workers to work in an elevated position above the ground where access to the individual elements is somewhat limited.

OBJECT OF THE INVENTION

The present invention is directed towards an antenna installation, wherein, an antenna carried by a mast mounted adjacent an upper end of a tower may be lowered into position closely adjacent the ground incident to downwardly swinging movement of the tower about a generally horizontally disposed axis into a lowered position.

More specifically, the invention is directed to an antenna installation, wherein an antenna is mounted on a mast by a gravity operated hinge mechanism, which permits the antenna to be unlatched for swinging movement relative to the mast, as an incident to downward swinging movement of a tower on which the mast is mounted, whereby to facilitate access to the antenna from the ground, and subsequently permits the antenna to be latched in its initial orientation relative to the mast, as an incident to upward swinging movement of the tower into its upstanding use position.

BRIEF SUMMARY OF THE INVENTION

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
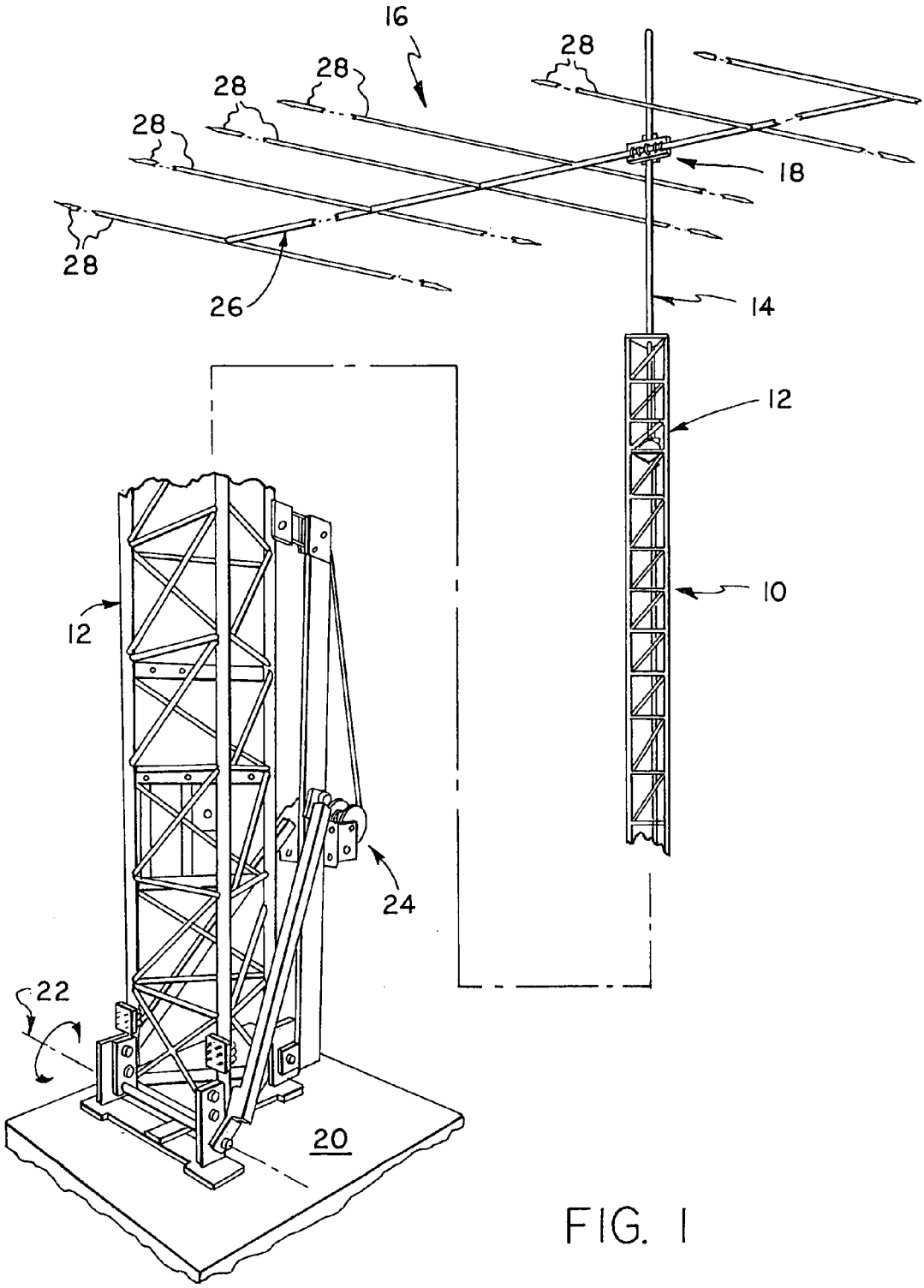
FIG. 1 is a prospective view of the antenna installation of the present invention.
Figure 3:
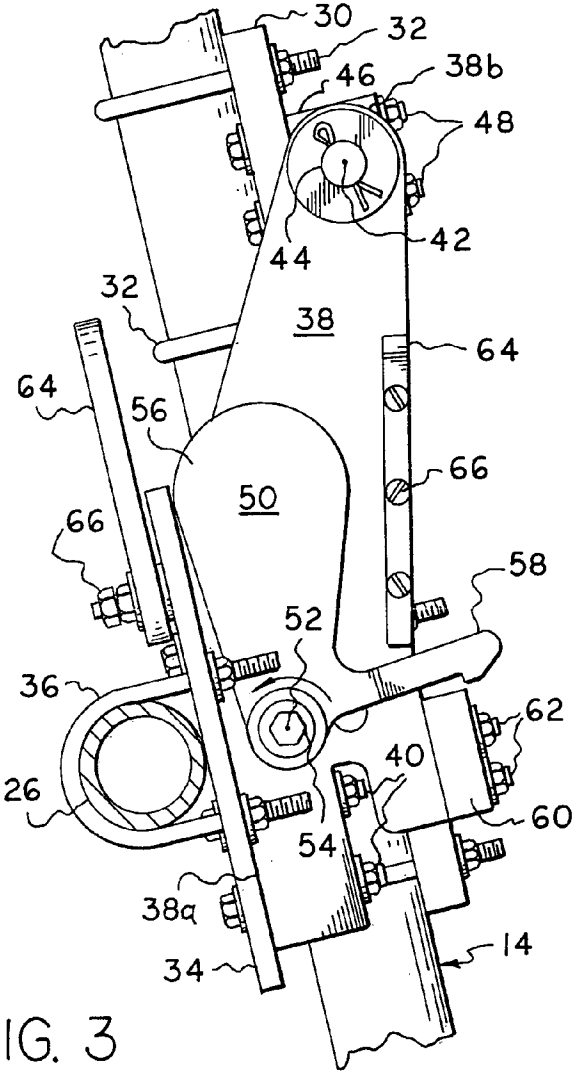
FIG. 3 is a side elevational view of the mechanism of FIG. 2, but showing a latch of the mechanism pivoted into a release position as an incident to pivotal movement of the mast toward its lowered position.
Figure 2:
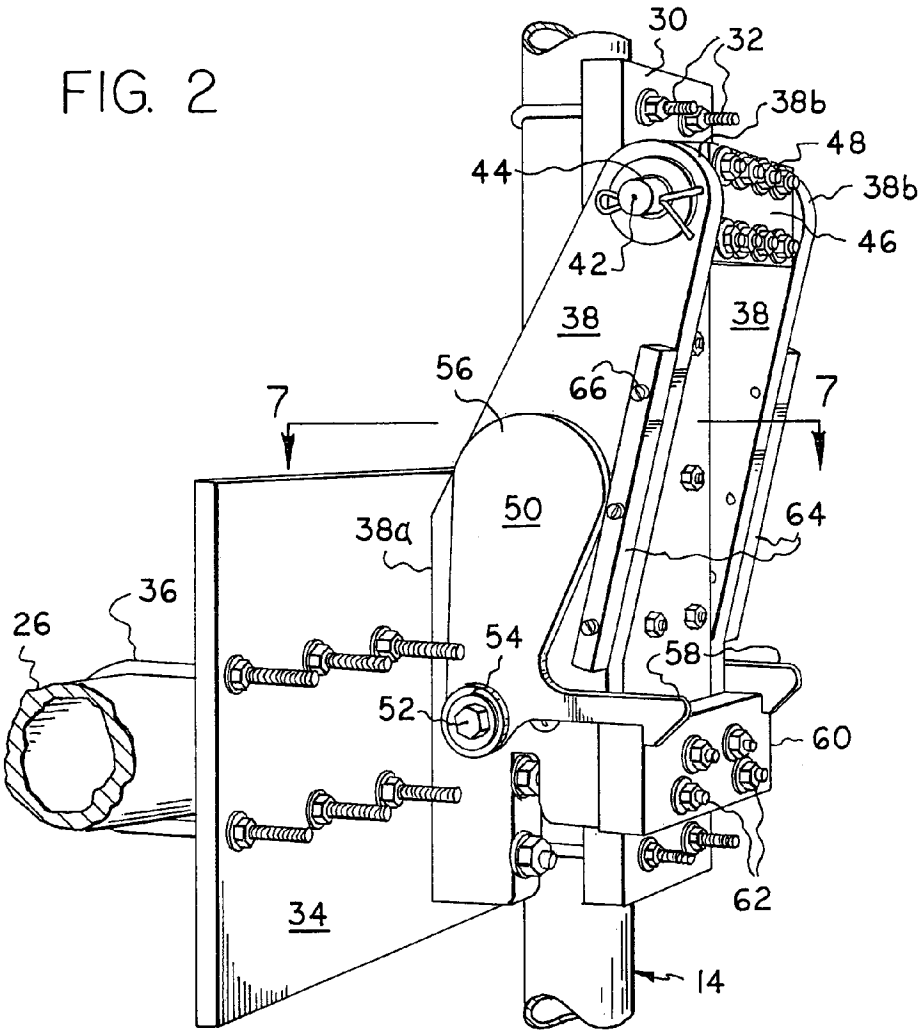
FIG. 2 is an enlarged prospective view of a hinge mechanism for use in supporting the antenna for pivotal movement relative to a tower-supported mast.

Reference is first made to FIG. 1, wherein an antenna installation 10 is shown as having a tower 12, including a mast 14 mounted adjacent its the upper end; and an antenna 16 mounted on the mast by the hinge mechanism 18. Tower 12 is suitably mounted on a support, such as a ground pad 20, for vertical pivotal movement about a first horizontal hinge axis 22 between a generally horizontally disposed lowered position, shown only for the case of mast 14 in FIGS. 4 and 6; and the vertically upstanding use position of the mast shown in FIGS. 1 and 2. Any suitable mechanism, such as a winch 24 shown in FIG. 1, may be employed to swing tower 12 vertically between its lowered and use positions. Other means, such as a locking bolts, not shown, may be employed and to selectively maintain the tower in its upstanding use position, wherein antenna 16 is elevated above surrounding buildings/terrain which might adversely interfere with its operation.

Figure 6:
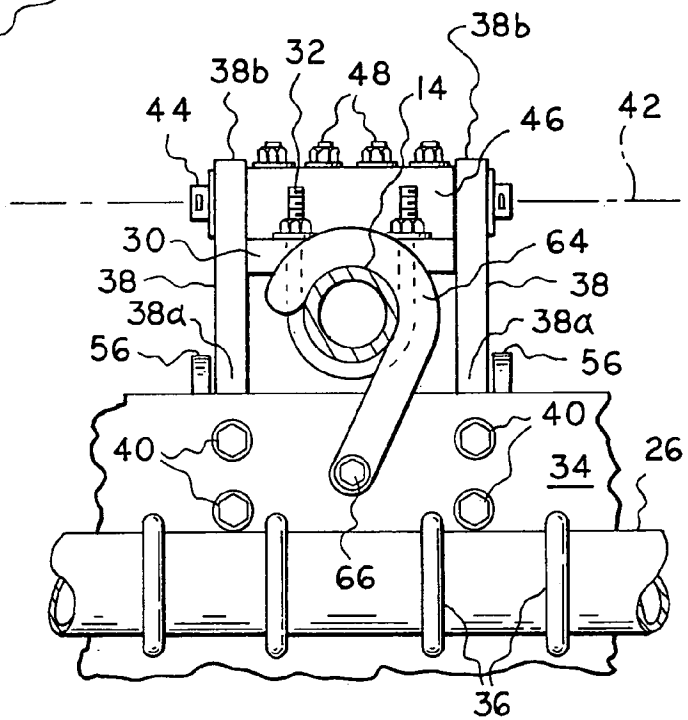
FIG. 6 is a sectional view taken generally along the line 6—6 in FIG. 5.
Figure 4:
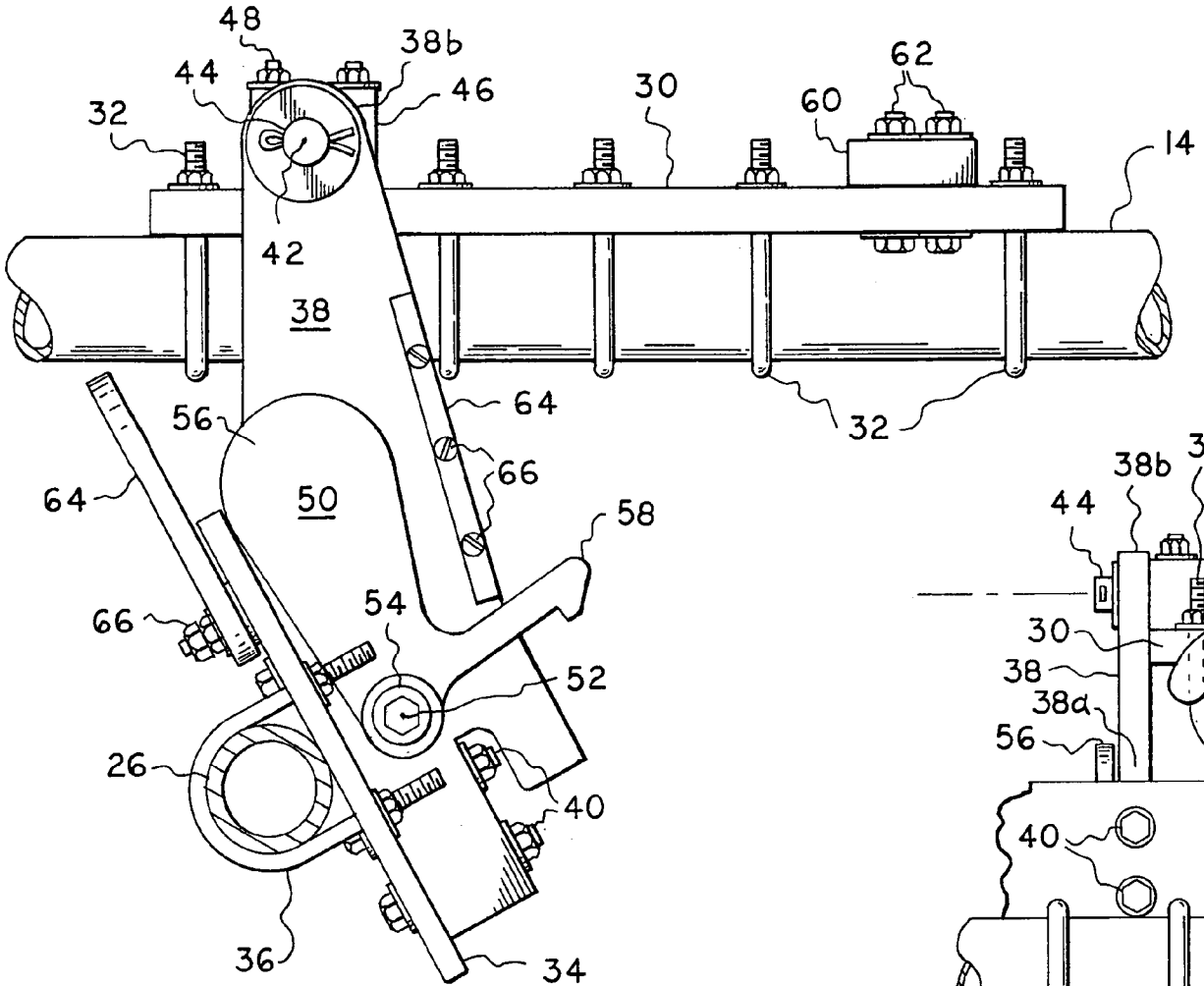
FIG. 4 is a side elevational view similar to FIG. 3, but showing the antenna pivoted relative to the mast incident to pivotal movement of the mast into its lowered position.

Antenna 16 is shown in FIG. 1 as including a boom 26 disposed adjacent a side of mast 14 arranged to face downwardly when the mast is disposed in the lowered position of tower 12, as shown in FIGS. 4 and 6; and a plurality of generally parallel antenna elements 28 mounted on boom 26 to lie generally within a common plane disposed normal thereto and normal to mast 14 when the tower is disposed in its upstanding use problem.

Hinge mechanism 18 is shown in FIGS. 2–7 as including a mast plate 30 adapted for attachment to mast 14, such as by a plurality of U-shaped, screw threaded clamps 32; a boom plate 34, adapted for attachment to boom 26, such as by a plurality of U-shaped screw threaded clamps 36; and a pair of parallel side plates 38 and 38 having first edges 38*a* and 38*a* rigidly fixed to boom plate 34 to extend normal thereto such as by threaded bolts 40, and second edges or ends 38*b* and 38*b* pivotallly coupled to mast 14 for rotation about a second hinge axis 42 via a bearing pin 44 received by a bearing plate 46 fixed to mast plate 30 by threaded bolts 48. Second axis 42 is disposed essentially parallel to axis 22.

Hinge mechanism 18 also includes latch means including a pair of latch plates 50 and 50 arranged parallel to and outwardly of side plates 38 and 38 and supported thereon for pivotal movement about a third axis 52 disposed essentially parallel to axes 42 and 42 by a hinge pin 54. Latch plates 50 and 50 are provided with enlarged or weighted ends 56 and 56, which operate under the influence of gravity to swing the latch plates between a first position shown in FIG. 2, wherein latch arms 58 and 58 carried adjacent opposite ends of the latch plates operatively engage with a latch receiver 60 fixed to mast plate 30 by bolts 62, and a second position shown in FIGS. 3 and 4, wherein the latch plates are disengaged from the receiver in order to free boom 26 for free swinging movement about second axis 42. Also it will be understood that when the latch plates are in latched condition, they additionally serve to reduce the wind induced flexures of antenna 16 about the axis of mast 14.

Preferably a pair of wind shields 64 and 64 are fixed to the oppositely facing surfaces of side plates 38 and 38 in order to prevent wind induced pivotal movements of latch arms 58 and 58 from engagement with latch receiver 60 when mast 14 is disposed in its use position.

From the forgoing, it will be understood that tower 12 may be swung downwardly from its upstanding use position into its lowered position about first axis 22, whenever it is desired to permit inspection, maintenance or installation of antenna 16. As tower 12 is lowered, the force of gravity acting on latch plated 50 and 50 serves to pivot the latch arms 58 and 58 about third axis 52 away form engagement with latch receiver 60 in order to free boom 26 for free downward swinging movement about second axis 42 until the boom reaches the position shown in FIG. 4 upon placement of tower 12 in its lowered position. Thereafter, antenna may be temporarily fixed to assume a position wherein elements 28 are disposed essentially parallel to mast 14 by means of a latch arm 64, which is pivotally fixed to boom plate 34 by a pivot pin 66 and arranged to be placed in removable engagement with boom 14, as shown in FIG. 6. When it is desired to return antenna to its initial elevated use position, it is necessary to first manually disengage latch arm 64 from mast 14, whereafter tower 12 may be swung upwardly into its upstanding position.

Figures 5, 7:
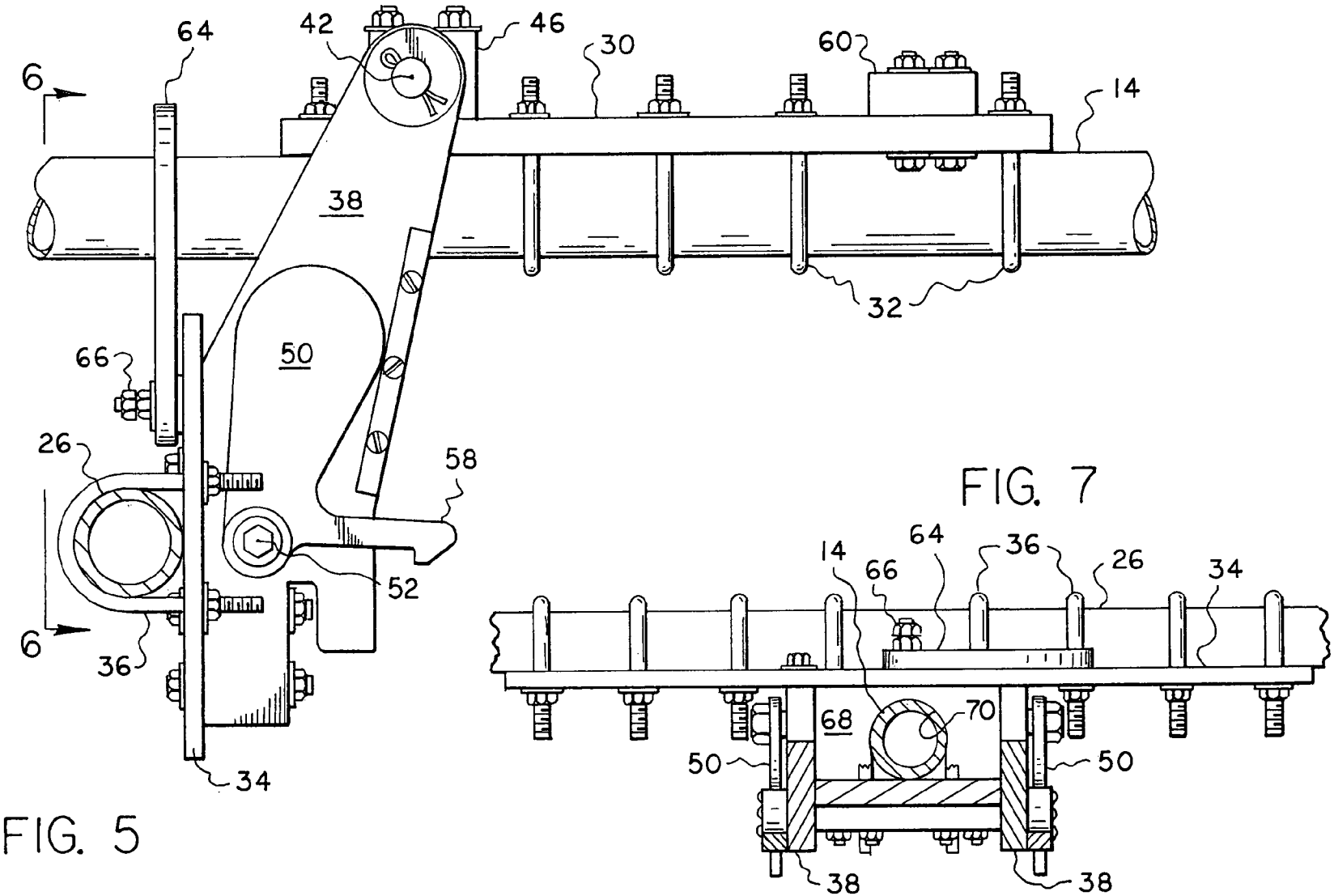
FIG. 5 is a side elevational view similar to FIG. 4, but showing the antenna fully pivoted relative to the mast under the influence of gravity, as the latter is disposed in its lowered position.
FIG. 7 is a sectional view taken generally along the line 7—7 in FIG. 2.

Finally, it is preferable to provide hinge mechanism 18 with a stabilizer plate 68, which is fixed to bridge between side plates 38 and 38 and provided with a mast receiving recess 70, which opens in direction away from the boom plate 34, as shown in FIG. 7.

We claim:

1. In an antenna installation having a tower including a mast supported adjacent its upper end and in turn being supported by a first hinge means for pivotal movement about a first horizontal axis between a generally horizontally disposed lowered and vertically upstanding use positions, and an antenna including a boom mounted on an mast and a plurality of antenna elements mounted on said boom to lie within a plane disposed generally normal to said mast when in said upstanding use position, the improvement comprising in combination:

a second hinge means for mounting said boom for pivotal movement relative to said mast about a second horizontal axis disposed generally parallel to said first horizontal axis, said boom being disposed adjacent a side of said mast arranged to face downwardly when said mast is disposed in said lowered position, and said boom tending to swing about said second axis in a direction away from said mast under the influence of gravity to position said plane at an inclined angle relative to said mast when in said lowered position.

2. The improvement according to claim 1, wherein latch means are provided to releasably latch said boom against pivotal movement relative to said mast about said second axis.

3. The improvement according to claim 2, wherein said latch means is a gravity operated latch means tending to release incident to downward pivotal movement of said mast about said first axis and reengage incident to upward pivotal movement of said mast about said first axis into said upstanding position.

4. The improvement according to claim 2, wherein further latch means are provided to releasably support said antenna on said mast when in said lower position, wherein said plane is disposed generally parallel to said mast.

5. The improvement according to claim 3, wherein further latch means are provided to releasably support said antenna on said mast when in lowered position, wherein said antenna elements are disposed generally parallel to said mast.

6. The improvement according to claim 1, wherein said second hinge means includes a mast plate for attachment to said mast, a boom plate for attachment to said boom, a pair of parallel side plates rigidly fixed to said boom plate to extend normal thereto, said mast plate extending sidewise between said side plates and being connected thereto for relative pivotal movement about said second axis.

7. The improvement according to claim 6, wherein latch means are provided to releasably latch said side plates against movement relative to said mast plate about said second axis.

8. The improvement according to claim 7, wherein said latch means includes a pair of pivotally supported, gravity operated latch plates supported on opposite facing surfaces of said side plates and arranged to releasably engage with a latch receiver carried by said mast plate to bridge across said side plates.

9. The improvement according to claim 8, wherein said boom plate pivotally supports a further latch means for releasably supporting said antenna on said mast when in lowered position, wherein said antenna elements are disposed generally parallel to said mast.

10. The improvement according to claim 8, wherein a pair of wind shields are fixed to oppositely facing surfaces of said side plates to prevent wind induced unlatching pivotal movements of said latch plates when said mast is in said upstanding use position.

11. The improvement according to claim 10, wherein further latch means are provided to releasably support said antenna on said mast when in said lowered position with said antenna elements being disposed generally parallel to said mast.

12. The improvement according to claim 11, wherein a boom stabilizer plate bridges between said side plates and is provided with a mast receiving recess opening in a direction away from said boom plate and adapted to removeably receive said mast when said side plates are releasably latched against movement relative to said mast plate about said second axis.

13. A hinge mechanism for supporting an antenna for pivotal movement about a horizontally disposed axis relative to an antenna mast of the type adapted to be swung vertically between a normal upstanding use position and a lowered position suitable for inspection/maintenance/installation of said antenna about a lower axis arranged parallel to said axis, said antenna including a boom and a plurality of antenna elements fixed to extend normal to said boom in approximately a common plane, said hinge mechanism comprising:

a mast plate for attachment to said mast;

a boom plate for attachment to said boom;

a pair of parallel side plates having first edges fixed to extend normal to said boom plate and opposite second edges cooperating with said mast plate to mount hinge means defining said axis;

a pair of parallel latch plates pivotally supported adjacent oppositely facing surfaces of said side plates for swinging movement about a common axis;

a latch receiver carried by said mast plate for engagement by said latch plates to releasably prevent pivotal movement of said boom plate relative to said mast plate about said axis, and said latch plates being adapted to be biased by gravity to disengage from said latch receiver to permit swinging movement of said boom plate about said axis incident to swinging movement of said mast into said lower position and to reengage with said latch receiver to constrain swinging movement of said boom plate about said axis incident to swinging movement of said mast into said upstanding use position.

14. A hinge mechanism according to claim 13, wherein a support hook is pivotally mounted on said boom plate and arranged to releaseably engage with said mast for supporting said antenna, when said mast is in said lowered position, to assume a position in which said antenna elements are disposed generally parallel to said mast.

15. A hinge mechanism according to claim 14, wherein a pair of wind shields are fixed to oppositely facing surfaces of said side plates to prevent wind induced unlatching pivotal movements of said latch plates towards said when said mast is in said upstanding use position.

16. A hinge mechanism according to claim 15, wherein a boom stabilizer plate bridges between said side plates and is provided with a mast receiving recess opening in a direction away from said boom plate and adapted to removeably receive said mast when said side plates are releasably latched against movement relative to said mast plate by said latch plates.

17. In an antenna installation having a tower including a mast supported adjacent its upper end and in turn being supported adjacent its lower end by a first hinge means for pivotal movement about a first horizontal axis between a generally horizontally disposed lowered and vertically upstanding use positions, and an antenna including a boom mounted on said mast and a plurality of parallel antenna elements mounted on said boom, the improvement comprising in combination:

a second hinge means adapted for mounting said boom for pivoted movement relative to said mast about a second horizontal hinge axis disposed parallel to said first axis; and, latch means for releaseably latching said boom against pivotal movement relative to said mast about said second axis, and said latch means is gravity operated tending to disengage and release said boom for free pivotal movement relative to said mast about said second axis incident to downward pivotal movement of said mast away from said upstanding use position and to reengage and constrain said boom against pivotal movement relative to said mast about said second axis incident to upward pivotal movement of said mast towards said upstanding position.

18. The improvement according to claim 17, wherein further latch means is provided to releasably constrain said boom against rotation relative to said mast about said second axis to retain said boom in a position in which said antenna elements are proposed to extend generally parallel to said mast.

* * * * *